US006345785B1

(12) United States Patent
Harkins et al.

(10) Patent No.: US 6,345,785 B1
(45) Date of Patent: Feb. 12, 2002

(54) DRAG-BRAKE DEPLOYMENT METHOD AND APPARATUS FOR RANGE ERROR CORRECTION OF SPINNING, GUN-LAUNCHED ARTILLERY PROJECTILES

(75) Inventors: Thomas E. Harkins, Joppa; Bradford S. Davis, Jarrettsville, both of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/708,242

(22) Filed: Nov. 7, 2000

Related U.S. Application Data

(60) Provisional application No. 60/178,643, filed on Jan. 28, 2000.

(51) Int. Cl.[7] ..... F42B 10/00

(52) U.S. Cl. ..... 244/3.23; 244/3.1; 244/3.21

(58) Field of Search ..... 244/3.1, 3.2, 3.23, 244/3.21; 701/10

(56) References Cited

U.S. PATENT DOCUMENTS 1,181,203 A * 5/1916 Alard ..... 701/220
3,737,122 A * 6/1973 Solov et al. ..... 244/3.21
4,646,990 A * 3/1987 Cleveland, Jr. ..... 244/3.21
4,899,956 A * 2/1990 King et al. ..... 244/3.21
5,497,704 A * 3/1996 Kurschner et al. ..... 102/264
5,762,291 A * 6/1998 Hollis et al. ..... 244/3.24
5,816,531 A * 10/1998 Hollis et al. ..... 244/3.27
5,826,821 A * 10/1998 Brandon et al. ..... 244/3.27
6,163,021 A * 12/2000 Mickelson ..... 244/3.2
6,208,936 B1 * 3/2001 Minor et al. ..... 701/220

OTHER PUBLICATIONS

Potential Accuracy Improvements of Inventory Artillery Projectiles Using a NATO–Compatible Dragster Fuze, ARL–MR–438 Feb. 1999, Thomas E. Harkins.

* cited by examiner

*Primary Examiner*—Michael J. Carone
*Assistant Examiner*—Gabriel S Sukman
(74) *Attorney, Agent, or Firm*—Paul S. Clohan, Jr.

(57) ABSTRACT

In a projectile launched by a gun, the projectile including a fuze with a longitudinal axis of symmetry and a braking device, an apparatus disposed in the fuze for determining a time of deployment of the braking device, the apparatus including a first accelerometer having a sense axis and mounted with its sense axis coincident with the longitudinal axis of symmetry of the fuze; a second accelerometer having a sense axis and mounted a known axial distance from the first accelerometer and with its sense axis coincident with the longitudinal axis of symmetry of the fuze; a magnetometer having a sense axis and mounted with its sense axis orthogonal to the longitudinal axis of symmetry of the fuze; a field-programmable memory unit loaded with aiming data of the gun, magnetic field direction at the gun, a nominal path length table, and a braking device maneuver authority table; and a microprocessor connected to the first and second accelerometers, the magnetometer, the field-programmable memory unit and the braking device.

9 Claims, 2 Drawing Sheets

DRAG-BRAKE DEPLOYMENT METHOD AND APPARATUS FOR RANGE ERROR CORRECTION OF SPINNING, GUN-LAUNCHED ARTILLERY PROJECTILES

CROSS-REFERENCE TO RELATED APPLICATIONS

The present application claims the benefit of priority of U.S. provisional patent application serial No. 60/178,643 filed on Jan. 28, 2000, which is hereby expressly incorporated by reference.

STATEMENT OF GOVERNMENT INTEREST

The invention described herein may be manufactured and used by or for the Government of the United States of America for government purposes without the payment of any royalties therefor.

BACKGROUND OF THE INVENTION

The present invention relates in general to range error correction of spinning, gun-launched artillery projectiles and, in particular, to deployment of a drag braking device for such projectiles.

In recent years, various concepts for increasing the accuracy of inventory artillery projectiles have been proposed. One of these, the range-correction concept, assumes that the gun is purposely aimed to overshoot its intended target. Using in-flight measurements, the range to impact of a projectile that is subjected to a host of launch and flight disturbances is estimated early in the trajectory. At a time determined by the range estimate, a drag-inducing device is deployed causing the projectile to impact at the intended target. Generically, this concept is called "Dragster."

The present invention is a simple and inexpensive apparatus and method for performing the range-to-impact estimation and commanding drag brake deployment when indicated. The apparatus incorporates a spin sensor, two axial acceleration sensors, and a processor. The drag brake used in the present invention is, for example, a D-ring type as disclosed in U.S. Pat. No. 5,816,531 entitled "Range Correction Module for a Spin Stabilized Projectile" issued to M. Hollis and F. Brandon on Oct. 6, 1998, which patent is hereby expressly incorporated by reference. The present invention has been named the D-ring Dragster fuze. In the D-ring Dragster fuze, all the components required to implement range correction can be incorporated as a modification of an existing artillery fuze and still satisfy operational requirements for fuze shape factor.

The metrics for accuracy improvement that make a Dragster system worthwhile are very much application-specific. The ability to deliver artillery fire onto a target is affected by many factors, some of which may not even be functions of the weapon system, e.g., target location error (TLE) and technique of fire. In cases where the impact locations of projectiles relative to their targets can either be observed or otherwise known, the aiming of subsequent rounds is adjusted until the desired impact locations are achieved. This technique is called "adjusted fire". At longer ranges where adjusted fire techniques are seldom desirable or practical, a technique called "predicted fire" is almost exclusively used. In predicted fire, the most current meteorological (MET) data and weapon system information are used along with a firing algorithm to generate an aiming solution to the location that has been identified as containing targets.

When using predicted fire, conventional uncorrected artillery projectiles have an elliptical fall of shot pattern with the range axis greatly exceeding the deflection axis. The purpose of a Dragster system is to reduce the range errors. However, there is little or no benefit in achieving range dispersions smaller than the associated deflection dispersions considering that there is no correction capability for the deflection errors in the postulated one-dimension correction system. Thus, the operational goal for Dragster is to achieve a fall of shot pattern centered at the aim point with the range errors roughly equal to the dispersion errors.

This goal leads to the requirement that the dispersion of the errors in the range-to-impact estimates be no greater than the deflection dispersion of uncorrected projectiles at that target range. Evaluation of the apparatus and method disclosed herein using a computerized six degree-of-freedom trajectory code shows this requirement is met. Significant reductions in range errors for the simulated Dragster rounds were achieved with the fall of shot patterns estimated for the Dragster rounds all approximately circular. This same basic result of the Dragster fuze achieving range errors roughly equal to dispersion errors would be anticipated for predicted fire of improved systems (e.g., better MET information) that would reduce dispersion of conventional rounds.

Known Dragster concepts either require in-flight information from external sources or actions by the weapon's crew beyond the current tactical procedures. Dragster systems proposed heretofore have included communication links, global positioning system (GPS) receivers, unique Dragster rounds, and/or a unique Dragster firing technique. The fuze-configured D-ring Dragster disclosed herein is fire-and-forget and makes no additional demands on the weapon crew. The only operational differences are the installation of Dragster fuzes on the projectiles (rather than some other fuze) and the selection of a Dragster mission in the weapon's fire control computer. These differences represent alternative choices for already required actions.

A Dragster fuze under development by others is known as STAR (Smart Trajectory Artillery Round). STAR differs from the Dragster apparatus disclosed herein in that STAR incorporates a GPS receiver to track the trajectory and provide inputs to the range-to-impact estimator.

The present invention makes a range-to-impact estimate (i.e., ground level distance) by comparing an on-board path length measurement (i.e., at a given time t, the distance the projectile has traveled along its trajectory) to a nominal path length provided by the weapon fire control computer (and loaded into a memory in the fuze prior to launch). This comparison is made early in the trajectory and the estimated overshoot distance is used to determine the time of deployment of the braking device. The on-board path length measurements are made using the outputs of a magnetic field strength sensor and two linear accelerometers. With appropriate processing, the magnetic sensor determines projectile spin rate and the accelerometers determine projectile drag. In turn, the spin rate is used to infer muzzle velocity and the drag is used to update the projectile's speed. Numerical integration then gives distance.

Kurschner, Erdmann, and Crist disclose the use of a magnetic sensor to calculate spin rate and muzzle velocity of spinning projectiles (See U.S. Pat. No. 5,497,704). Though Dragster estimates the same rates (i.e., projectile spin and muzzle velocity) from turn counts in the earth's magnetic field as does Kurschner's device, the Dragster further uses the spin rate estimate in conjunction with calibration data to remove measurement bias from the axial acceleration sensors outputs. Additionally, the method for deriving projectile spin rate from magnetic turn counts differs from that of Kurschner et al. by including processing to compensate for the potential difference between projectile spin rate and magnetic field crossing rate created by projectile yawing motion.

BRIEF DESCRIPTION OF THE DRAWINGS

Throughout the Figures, reference numerals that are the same refer to the same features.

DETAILED DESCRIPTION OF THE PREFERRED EMBODIMENTS

Incorporation of the Dragster range-correction concept does not necessitate development of an entirely new fuze but can be implemented as a modification of an existing fuze. For example, the U.S. Army Armament, Research, Development, and Engineering Command (ARDEC) is engaged in a development effort for the M773 Multi-Option Fuze for Artillery (MOFA) where the hand-set/display features have been eliminated. This new fuze is the XM782. The D-ring Dragster system has been designed to be incorporated into an XM782 fuze in the region where the hand-set options were previously located. A slight increase in overall length was made, but the Dragster fuze still limits the overall fuze plus projectile length to less than 1000 mm.

Figure 1:
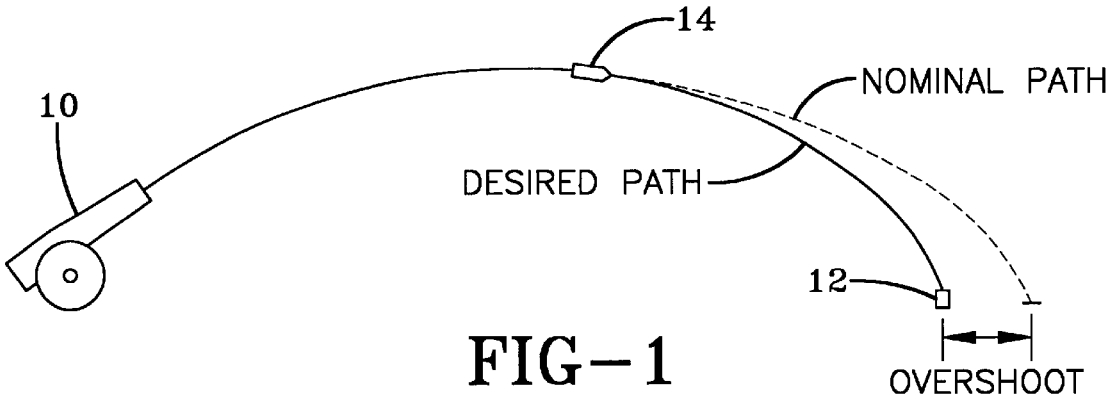
FIG. 1 schematically shows a nominal and desired path of a projectile.

FIG. 1 schematically shows a nominal and desired path of a projectile 14. Projectile 14 is launched from gun 10 toward target 12. The nominal (preprogrammed) path of the projectile is shown in dotted lines. The desired (corrected) path of the projectile is shown in solid line. The nominal path typically includes an overshoot, as shown in FIG. 1.

Figure 2:
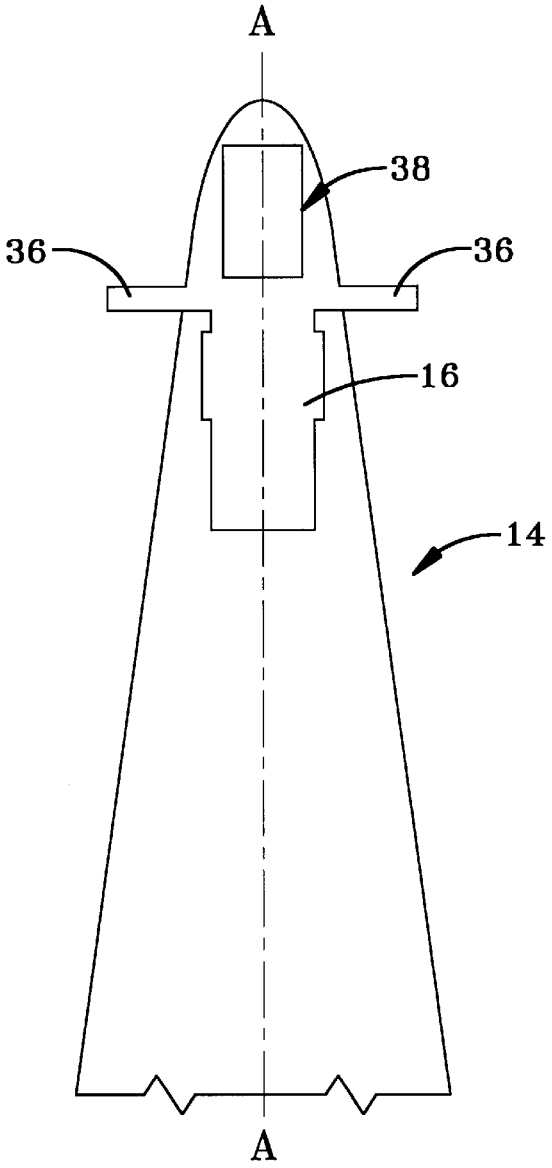
FIG. 2 schematically shows a projectile.

FIG. 2 schematically shows a projectile 14 including a fuze 16 removably attached thereto by, for example, threads. Projectile 14 includes a longitudinal axis of symmetry A—A. Fuze 16 includes a known braking device 36, such as the braking device described in U.S. Pat. No. 5,816,531 that was discussed earlier. In FIG. 2, the braking device 36 is shown in the deployed state. Braking device 36 increases the drag of the projectile 14, thereby decreasing the overshoot.

Figure 3:
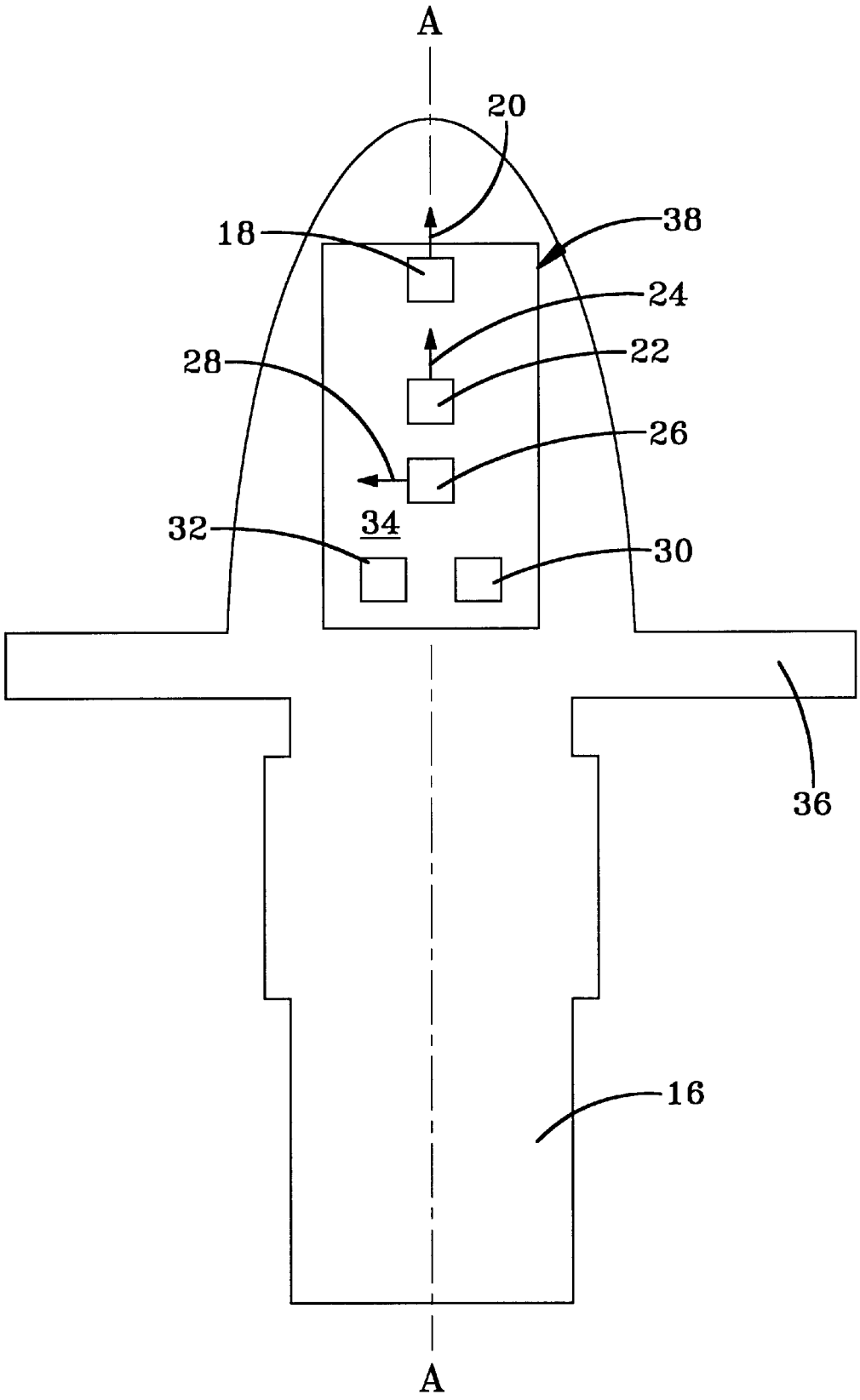
FIG. 3 schematically shows one embodiment of the apparatus of the invention.

FIG. 3 schematically shows one embodiment of the apparatus 38 of the invention. Apparatus 38 is disposed in the fuze 16 and determines the time of deployment of the braking device 36. Apparatus 38 includes a microprocessor 32, two axially-oriented accelerometers 18, 22, a field-programmable memory unit 30, a radially-oriented magnetometer 26, and a mounting board with support electronics 34. The components of the mounting board and required support electronics 34 are within the knowledge of those of skill in the art and will not be discussed in further detail.

Accelerometer 18 has a sense axis 20 and is mounted with its sense axis 20 coincident with the longitudinal axis of symmetry A—A of the fuze 16. Accelerometer 22 has a sense axis 24 and is mounted a known axial distance from accelerometer 18. Sense axis 24 is also coincident with the longitudinal axis of symmetry A—A of the fuze 16. Magnetometer 26 has a sense axis 28 and is mounted with its sense axis 28 orthogonal to the longitudinal axis of symmetry A—A of the fuze 16.

Prior to firing, the field-programmable memory unit 30 is loaded with the gun aiming data (azimuth and elevation), magnetic field direction at the gun (inclination and declination), the nominal path length table, and the D-ring (braking device 36) maneuver authority table based on the fire control solution to the target range under the measured conditions. Microprocessor 32 is connected to accelerometers 18, 22, magnetometer 26, field-programmable memory unit 30 and braking device 36.

A braking device deployment method has been devised for spin-stabilized artillery rounds using measurements from magnetometer 26 (spin sensor) and axial accelerometers 18, 22. In practice, the magnetometer 26 and accelerometer 18, 22 outputs can not be used directly as measures of the desired spin rate and axial acceleration but must be processed to remove the effects of sensor errors and complex projectile kinematics on those measurements. After having done this, muzzle velocity is estimated from a spin measurement at launch using the twist equation. Axial acceleration is used to update a pseudo-velocity estimate that ignores gravity and coriolis accelerations. Integration of these velocities gives pseudo path length estimates.

Muzzle Velocity Determination

The relationship between muzzle velocity and spin rate in a rifled gun tube can be calculated by the following expression:

$$V=pTd, \tag{1}$$

in which V=velocity (m/s), p=spin rate (rev/s), T=gun twist (cal/rev), and d=projectile diameter (m/cal). Since the gun's twist and projectile's diameter are relatively constant, muzzle velocity becomes solely a function of the initial spin rate. The accuracy of this method depends largely on the measurement of the gun's twist and the projectile's diameter. Measurement techniques are available to precisely determine these quantities. This technique also assumes that no rotating band slippage occurred.

The magnetometer 26 output is processed with a rolling sine wave fit to determine the projectile's magnetic roll frequency, amplitude, offset, and phase shift every roll cycle. The resulting frequency and amplitude represent the roll rate and yawing motion with respect to the earth's magnetic field. Magnetic roll rate and projectile spin are related by $$\dot{\phi}_M=p+r*\tan(\theta_M), \tag{2}$$

where $\dot{\phi}_M$ is the roll rate with respect to the magnetic field, r is the projectile yawing rate component orthogonal to the plane containing the projectile spin axis and the magnetic field vectors through that axis, and $\theta_M$ is the complement of the angle between the spin axis and the magnetic field. Prior art uses $\dot{\phi}_M$ as an estimator of p. In cases where r * tan($\theta_M$) is "large", failure to account for this contribution leads to a significant muzzle velocity error.

Axial Acceleration

At an arbitrary point (Δi, Δj,0) within a projectile, the component of acceleration parallel to the longitudinal axis of the projectile is given by:

$$A_i=\dot{u}+wq-vr-\Delta i(q^2+r^2)+\Delta j(pq-\dot{r}) \tag{3}$$

The radial acceleration component is give by:

$$A_j=\dot{v}+ru-pw+\Delta i(pq+\dot{r})+\Delta j(-p^2-r^2) \tag{4}$$

where Δi and Δj are the axial and radial offsets from the center of gravity (c.g.); u, v, and w are the projectile velocity components as defined in a body-fixed coordinate system as commonly used by ballisticians; and p, q, and r are the projectile angular velocity components in this body-fixed system. Because an accelerometer on a projectile in free flight does not sense gravity, the output of a perfect axial accelerometer at this location would be $A_{i_s}=A_i-g \sin \theta$. $A_{i_s}$ is usually called the sensed acceleration.

The sensed axial acceleration component at the c.g.

$$\left(A_{i_{s_{cg}}} = \dot{u} + wq - vr - g\sin\theta\right)$$

is the quantity required for the pseudo path length computation. This quantity can be isolated algebraically by combining the sensed axial accelerations at two locations on the spin axis. If two perfect, axially-oriented accelerometers were exactly located at $(\Delta i_1, 0,0)$ and $(\Delta i_2, 0,0)$ respectively, their outputs ($S_1$ & $S_2$) could be used to find $$A_{i_{s_{cg}}}$$

by computing $(\Delta i_2 S_1-\Delta i_1 S_2)/(\Delta i_2-\Delta i_1)$.

However, the perfect accelerometer has yet to be built. Because of manufacturing and installation tolerances, sensor location and alignment uncertainties virtually guarantee that measurements made by accelerometers intended to determine axial forces will include contributions from the radial forces. For spin-stabilized projectiles, the radial acceleration at any point offset from the spin axis is dominated by the term containing the centrifugal acceleration, i.e., $(\Delta j[-p^2-r^2])$. These radial offsets could be due to any of the following; sensor die to sensor package misplacement, sensor package to bullet axis misplacement, or from an imbalanced projectile. Imbalance would cause the spin axis to be different from the geometrical axis of symmetry. Inherent sensor errors like cross-axis sensitivity create a similar bias effect and are almost indistinguishable from radial offset affects. For simplicity, all of these effects can be lumped together. The accelerometer pair can be calibrated for centrifugal acceleration in the laboratory while undergoing controlled motions. Alternatively, this calibration can be estimated at launch using the spin rate and launch velocity estimates obtained from the magnetic sensor combined with the meteorological information at the gun location.

In the laboratory, after installation of the accelerometers 18, 22, the fuze 16 is vertically oriented and the accelerometer outputs are measured. The fuze is then spun at known fixed rates and the outputs measured. Any differences from the static measurements are used to determine the radial offsets of the accelerometers from the centrifugal acceleration equation. The accelerometers' in-flight outputs can then be corrected for this bias acceleration with the spin rate information determined by the magnetometer 26.

A linear combination of these two corrected estimates ($\overline{S}_1$ & $\overline{S}_2$) then is formed to eliminate any bias to the desired estimate of the axial acceleration component ($\overline{A}_i$) at the cg resulting from the $\Delta i(q^2+r^2)$ term in Equation 3. Viz:

$$(\Delta i_2\overline{S}_1-\Delta i_1\overline{S}_2)/(\Delta i_2-\Delta i_1)=\overline{A}_i+(\Delta i_2\Delta j_1-\Delta i_1\Delta j_2)(pq-\dot{r})/(\Delta i_2-\Delta i_1) \quad (5)$$

Though this process does not completely isolate the axial acceleration component ($\overline{A}_i$) the remaining additional term $(\Delta i_2\Delta j_1-\Delta i_1\Delta j_2)(pq-\dot{r})/(\Delta i_2-\Delta i_1)$ is zero mean and oscillatory and averages out in the path length estimation process. Using the acceleration estimates from Equation 5 and the muzzle velocity estimate, numerical integration gives a pseudo path length estimate for the current trajectory.

Given pre-calculated pseudo path length values along a nominal trajectory, comparison at two times on the projectile's upleg (i.e., within the first 25% of the path length) with the pseudo path lengths for a trajectory subjected to launch and flight disturbances is used to estimate the range error. If $P_{nom}$ (t) is the nominal path length and $P_{act}$ (t) is the path length estimate on the current trajectory, the range error estimate is given by:

$$\Delta R = [P_{act}(t_1) - P_{nom}(t_1)] + \left[\frac{\{P_{act}(t_2) - P_{nom}(t_2)\} - \{P_{act}(t_1) - P_{nom}(t_1)\}}{t_2 - t_1}\right](t_{imp} - t_1) \quad (6)$$

where $t_{imp}$ is the time of flight of the nominal trajectory.

This range error is added to the overshoot of the nominal trajectory to give a total range error with respect to the desired impact location. Using a pre-calculated table of range reduction versus deployment time for the nominal trajectory, a time estimate for deploying the braking device 36 for the current trajectory is obtained.

EXAMPLE

Two M483A1 artillery projectiles were instrumented with fuze-configured telemetry packages and fired at Aberdeen Proving Ground, Md. The telemetry packages contained axial accelerometers and magnetic spin sensors. The spin sensor and accelerometer data were post processed as described in the methodology description. The estimated muzzle velocity using the magnetic spin counter was within 0.5% of the muzzle velocity determined by a Weibel radar. Next, the sensed acceleration from the axial accelerometer was compensated for the bias component using laboratory calibration data and the on-board spin counter data. It was then compared to acceleration data using the derivative of the Weibel radar velocity data and correcting it for gravity. The accelerations differed by less than 5%. The measured data from the instrumented flight test were then used in the range error correction algorithm. The measured data were consistent with theoretical data.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. In a projectile launched by a gun, the projectile including a fuze with a longitudinal axis of symmetry and a braking device, an apparatus disposed in the fuze for determining a time of deployment of the braking device, the apparatus comprising:

a first accelerometer having a sense axis and mounted with its sense axis coincident with the longitudinal axis of symmetry of the fuze;

a second accelerometer having a sense axis and mounted a known axial distance from the first accelerometer and with its sense axis coincident with the longitudinal axis of symmetry of the fuze;

a magnetometer having a sense axis and mounted with its sense axis orthogonal to the longitudinal axis of symmetry of the fuze;

a field-programmable memory unit loaded with aiming data of the gun, magnetic field direction at the gun, a nominal path length table, and a braking device maneuver authority table; and a microprocessor connected to the first and second accelerometers, the magnetometer, the field-programmable memory unit and the braking device.

2. Using the apparatus of claim 1, a method for determining a time of deployment of the braking device, comprising:

calibrating the first and second accelerometers to determine a bias acceleration;

launching the projectile from the gun;

measuring a spin rate of the projectile at a muzzle of the gun;

determining the muzzle velocity of the projectile;

determining path lengths of the projectile at two times, $t_1$ and $t_2$, after launch of the projectile;

calculating a range error estimate;

adding the range error estimate to an overshoot from the nominal path length table to define a total range error;

using a table of range reduction versus deployment time from the braking device maneuver authority table, determining the time of deployment of the braking device;

sending a deploy signal from the microprocessor to the braking device; and deploying the braking device.

3. The method of claim 2 wherein the step of determining the muzzle velocity of the projectile includes calculating the muzzle velocity from the equation:

$$V=pTd,$$

where V=velocity (m/s), p=spin rate (rev/s), T=gun twist (cal/rev), and d=projectile diameter (m/cal).

4. The method of claim 3 wherein the spin rate p is calculated from the equation:

$$\dot{\phi}_M=p+r^*\tan(\theta_M),$$

where $\dot{\phi}_M$ is the roll rate with respect to the magnetic field, r is the projectile yawing rate component orthogonal to the plane containing the projectile spin axis and the magnetic field vectors through that axis, and $\theta_M$ is the complement of the angle between the spin axis and the magnetic field.

5. The method of claim 4 wherein the step of determining path lengths of the projectile at two times, $t_1$ and $t_2$, after launch of the projectile includes integrating the muzzle velocity and the axial acceleration at $t_1$ and $t_2$.

6. The method of claim 5 wherein the axial acceleration is determined by correcting outputs $S_1$ and $S_2$ of the first and second accelerometers, respectively, for the bias acceleration to obtain corrected outputs ($\overline{S}_1$ & $\overline{S}_2$).

7. The method of claim 6 wherein the axial acceleration is determined from the quantity $(\Delta i_2\overline{S}_1-\Delta i_1\overline{S}_2)/(\Delta i_2-\Delta i_1)$, where ($\overline{S}_1$ & $\overline{S}_2$) are the corrected outputs of the first and second accelerometers, respectively, and $\Delta i_1$ and $\Delta i_2$ are the axial distances from the center of gravity of the projectile to the first and second accelerometers, respectively.

8. The method of claim 7 wherein $t_1$ and $t_2$ are times within the first 25% of the projectile's trajectory.

9. The method of claim 7 wherein the step of calculating a range error estimate includes solving the equation:

$$\Delta R = [P_{act}(t_1) - P_{nom}(t_1)] + \left[\frac{\{P_{act}(t_2) - P_{nom}(t_2)\} - \{P_{act}(t_1) - P_{nom}(t_1)\}}{t_2 - t_1}\right](t_{imp} - t_1) \quad (6)$$

where delta R is the range error estimate; $P_{act}(t)$ are the path length estimates at $t_1$ and $t_2$ derived from the step of determining path lengths of the projectile at two times, $t_1$ and $t_2$, after launch of the projectile; $P_{nom}(t)$ are the nominal path lengths at $t_1$ and $t_2$ derived from the nominal path length table stored in the field-programmable memory unit; and $t_{imp}$ is the time of flight of the projectile from launch to impact derived from the nominal path length table stored in the field-programmable memory unit.

* * * * *